US009609892B2

(12) United States Patent
Orvis et al.

(10) Patent No.: US 9,609,892 B2
(45) Date of Patent: Apr. 4, 2017

(54) WIND RESISTANT SMOKING DEVICE AND METHOD OF USE THEREOF

(71) Applicants: Tracy S. Orvis, Mesa, AZ (US); J. Howell McCall, Mesa, AZ (US)

(72) Inventors: Tracy S. Orvis, Mesa, AZ (US); J. Howell McCall, Mesa, AZ (US)

( * ) Notice: Subject to any disclaimer, the term of this patent is extended or adjusted under 35 U.S.C. 154(b) by 257 days.

(21) Appl. No.: 14/320,497

(22) Filed: Jun. 30, 2014

(65) Prior Publication Data

US 2015/0007833 A1 Jan. 8, 2015

Related U.S. Application Data

(60) Provisional application No. 61/842,094, filed on Jul. 2, 2013.

(51) Int. Cl.

| | |
|---|---|
| ***A24F 13/14*** | (2006.01) |
| ***A24F 13/22*** | (2006.01) |
| ***A24D 1/12*** | (2006.01) |

(52) U.S. Cl.

CPC ..... *A24F 13/14* (2013.01); *A24D 1/12* (2013.01); *A24F 13/22* (2013.01)

(58) Field of Classification Search

CPC . A24F 13/14; A24F 13/22; A24D 1/12; A24B 13/16

USPC ..... 131/174, 175

See application file for complete search history.

(56) References Cited

U.S. PATENT DOCUMENTS

| | | | | |
|---|---|---|---|---|
| 1,996,829 A * | 4/1935 | Peterson | A24F 13/08 | 131/188 |
| 2,079,520 A * | 5/1937 | Mills | A24F 13/14 | 131/175 |
| 3,237,629 A * | 3/1966 | Sauer, Sr. | A24F 13/14 | 131/175 |
| 3,821,958 A * | 7/1974 | Overleese | A24D 1/12 | 131/174 |
| 4,289,149 A * | 9/1981 | Kyriakou | A24F 13/14 | 131/175 |
| 2005/0051183 A1* | 3/2005 | Coulthard | A24F 13/18 | 131/256 |

OTHER PUBLICATIONS

Orvis Tracy, At last, you can ride a motorcycle and smoke a cigar at the same time, Aug. 14, 2014 [downloaded online Oct. 11, 2016], PR Newswire iReach.*

* cited by examiner

*Primary Examiner* — Anthony Calandra
(74) *Attorney, Agent, or Firm* — Schmeiser, Olsen & Watts LLP

(57) ABSTRACT

A smoking device is provided. The smoking device may include a body having a through bore that is configured to house a tobacco product. The body may have grooves in an exterior surface that can direct air flow over the surface of the body under windy conditions. The smoking device may include a cap configured to engage the body near the foot of the tobacco product. The cap and the body may create a cavity there between, the cavity being in fluidic communication with the through bore. The grooves can be oriented to run parallel with a length of the body. The grooves may also be configured to create a space between the body and the cap, such that ambient air may flow into the grooves and thus be channeled into the space and into the cavity and into the through bore to maintain the burn on the tobacco product.

15 Claims, 10 Drawing Sheets

WIND RESISTANT SMOKING DEVICE AND METHOD OF USE THEREOF

CROSS-REFERENCE TO RELATED APPLICATION

This application claims priority to U.S. Provisional Patent Application to McCall et al., entitled "WIND RESISTANT SMOKING DEVICE AND METHOD OF USE THEREOF," Ser. No. 61/842,094, filed Jul. 2, 2013, the disclosure of which is hereby incorporated entirely herein by reference.

BACKGROUND

Technical Field

This disclosure relates generally to smoking devices and in particular to a smoking device for use in windy or wind-like conditions.

State of the Art

Smoking in circumstances that create windy conditions can be a challenge. For example, riding a motorcycle, operating a boat, riding in a convertible, or any other condition that exposes a person to windy conditions can make smoking difficult or impossible, not to mention the dangers presented to inexperienced enthusiasts and/or the environment.

There are only two places to put a lit tobacco product while engaging in behavior that generates windy conditions—in one's mouth or in one's hand. Nevertheless, in either case, the lit tobacco product must be shielded from the wind. And, while in the mouth, great care must be taken in an attempt to limit the amount of ash that may be blown back into the user's eyes and face. These concerns force the operator to constantly determine how to manage the operation of the equipment and the tobacco product at the same time. For example, where does the lit tobacco product go in an emergency? The mouth? The hand? The ground? How is the lit tobacco product to be shielded from the wind? And where does the tobacco product end up? Does the operator wait for the tobacco product to self-extinguish or does the operator try to extinguish it? Worse yet, does the operator simply toss it, raising safety concerns to the surrounding environment, especially in dry conditions?

In the case of a cigar, the dangers to the operator can be more severe. Swirling air currents can cause the cigar to disintegrate, burn unevenly, or even turn into a roman candle, which poses a major health risk to those individuals that have a beard.

Thus, there is a need in the tobacco industry for a device that addresses the concerns raised above and allows an operator to enjoy a good smoke while operating a vehicle or other motorized machine that may create windy or wind-like conditions.

SUMMARY

The present disclosure relates to smoking devices and in particular to a wind-resistant smoking device.

An aspect of the present disclosure includes a smoking device comprising a body having a first end, a second end, and a through bore running from the first end to the second end, the body being configured to house a product in the through bore, a cap configured to be adjustable with respect to the body to define a space between the cap and the body, the space being in fluidic communication with the through bore, and grooves in an exterior surface of the body, wherein the grooves are in fluidic communication with the space.

Another aspect of the present disclosure includes a collar configured to operatively engage the second end of the body, the cap being configured to operatively engage the collar and be adjustable with respect to the collar to define the space between the cap and the second end.

Another aspect of the present disclosure includes a collet configured to operatively engage the body proximate the first end of the body, wherein the collet is configured to rotate with respect to the body to transition the smoking device between an engaged state and disengaged state.

Another aspect of the present disclosure includes wherein the grooves are configured to run underneath the collar to establish the fluidic communication with the space.

Another aspect of the present disclosure includes a receptacle in the body, the receptacle being configured to house a piston, wherein the collet is configured to operatively engage the piston such that rotation of the collet to the engaged position moves the piston radially inward and wherein rotation of the collet to the disengaged position permits the piston to move radially outward.

Another aspect of the present disclosure includes wherein in the engaged position the piston contacts the product to retain the product within the through bore and wherein in the disengaged position the piston releases contact with the product.

Another aspect of the present disclosure includes wherein in the engaged position contact force moves the piston radially inward and wherein in the disengaged position magnetic force moves the piston radially outward.

Another aspect of the present disclosure includes magnets on an exterior surface of the smoking device.

Another aspect of the present disclosure includes a port in the body, the port being configured to establish fluidic communication between the through bore and ambient air.

Another aspect of the present disclosure includes wherein the body is configured to house the product within the through bore with a gap between the product and the interior surface of the through bore.

Another aspect of the present disclosure includes a biasing member configured between the collar and the cap to bias the cap away from the body.

Another aspect of the present disclosure includes a mouthpiece proximate the first end of the body, the mouthpiece being configured to operatively engage the product.

Another aspect of the present disclosure includes a smoking device comprising a body having a first end, a second end, and a through bore running from the first end to the second end, the body being configured to house a cigar in the through bore, a collar configured to operatively engage the second end of the body, a cap configured to operatively engage the collar and to be adjustable with respect to the second end of the body, the cap and the second end defining there between a space, the space being in fluidic communication with the through bore, grooves in an exterior surface of the body, wherein the grooves are configured to run underneath the collar to establish the fluidic communication with the space, a mouthpiece configured to operatively engage the cigar, and a collet configured to operatively engage the body proximate the first end of the body, the collet being configured to rotate about the body to transition the smoking device between an engaged state and disengaged state, wherein in the engaged state the cigar is secured within the through bore and wherein in the disengaged state the cigar is removable from the through bore.

Another aspect of the present disclosure includes a receptacle in the body, the receptacle being configured to house a piston, wherein the collet is configured to operatively engage the piston such that rotation of the collet to the engaged position moves the piston radially inward and wherein rotation of the collet to the disengaged position permits the piston to move radially outward.

Another aspect of the present disclosure includes wherein in the engaged position the piston contacts the product to retain the product within the through bore and wherein in the disengaged position the piston releases contact with the product.

Another aspect of the present disclosure includes wherein in the engaged position contact force moves the piston radially inward and wherein in the disengaged position magnetic force moves the piston radially outward.

Another aspect of the present disclosure includes a method of smoking a product, the method comprising providing a smoking device, inserting the product into the smoking device, lighting the product within the smoking device, attaching the smoking device to a moving vehicle, orienting the smoking device in relation to the direction of travel, and removing the smoking device from the vehicle while operating the vehicle to smoke the product.

Another aspect of the present disclosure includes orienting the length of the smoking device on the vehicle in parallel with the direction of travel, with a first end of the smoking device being a leading end to allow the product to remain lit within the device.

Another aspect of the present disclosure includes orienting the length of the smoking device on the vehicle in parallel with the direction of travel, with a second end of the smoking device being a leading end to allow the product to extinguish within the device.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
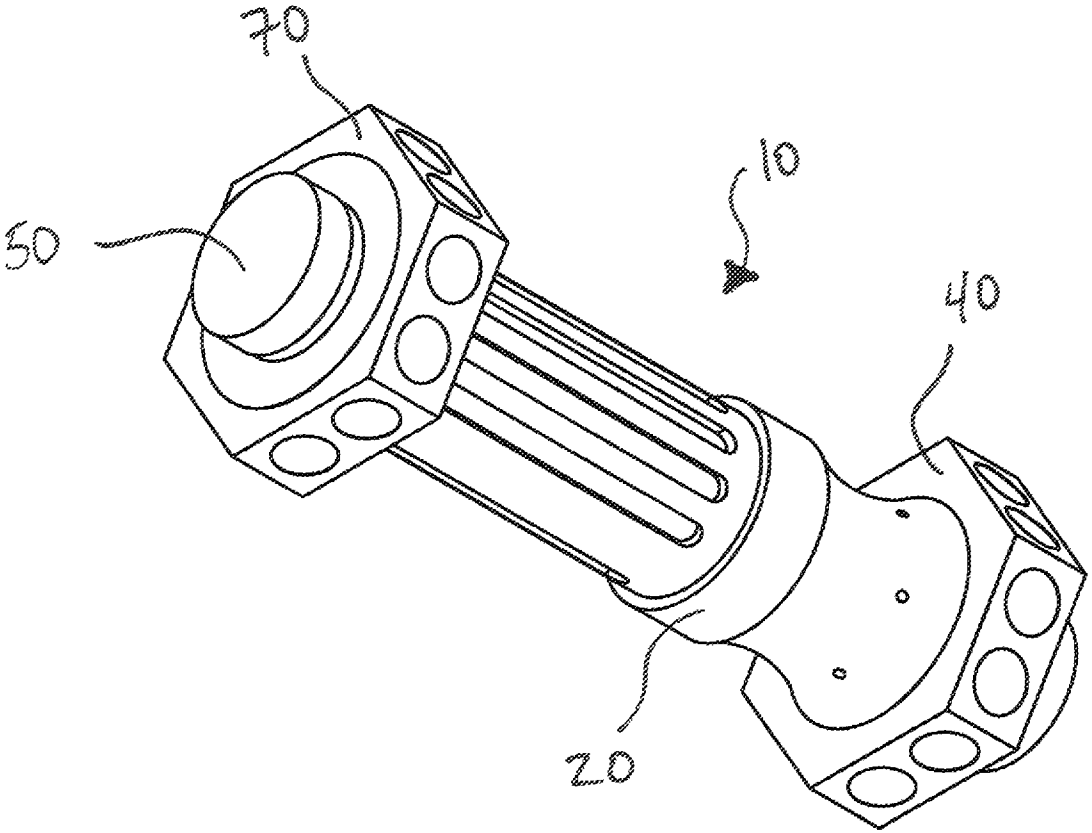
FIG. 1 is a perspective view of an embodiment of a smoking device in accordance with the present disclosure.

Referring to the drawings, FIG. 1 depicts an exemplary embodiment of components of a smoking device 10. Embodiments of the smoking device 10 may comprise various components, including, but not limited to, a body 20, a collet 40, a cap 50, and a collar 70. The smoking device 10 may be configured to house therein a product 6 that may be smoked, such as cigar, cigarette, or other like smokeable products (hereinafter referred to collectively as "cigar"). Once housed within the smoking device 10, the cigar may be smoked according to the preference of the user. Indeed, the smoking device 10 may be configured to allow the user to efficiently and safely smoke the cigar even in windy conditions, such as, for example, while riding a motorcycle, which will be described in greater detail herein.

As known in the art, a cigar may include a foot end and a head end, the head end having a cap thereon. Before smoking the cigar, the cap of the cigar must first be cut off, or otherwise pierced or broken, to allow air to pass through the body of the cigar when the user puffs on the head of the cigar. To light the cigar, the foot of the cigar must be lit by fire or other burn-inducing devices to allow the cigar to begin to burn and create smoke, which may then be drawn into the user's mouth and there savored by the user. An evenly distributed burn down the length of the cigar from the foot to the head is desirable, so as to prolong the life and quality of the cigar. Most cigars also have a band wrapped around the body to label the brand name of the cigar. The band can be removed prior to lighting the cigar or shortly thereafter, as preferred by the user.

Figure 2A:
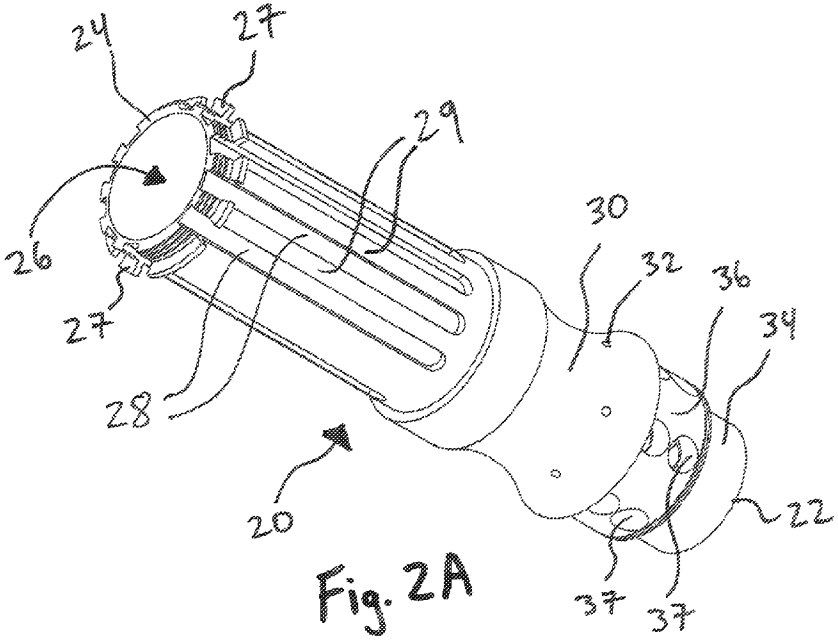
FIG. 2A is a perspective view of a component of an embodiment of a smoking device in accordance with the present disclosure.
Figure 2B:
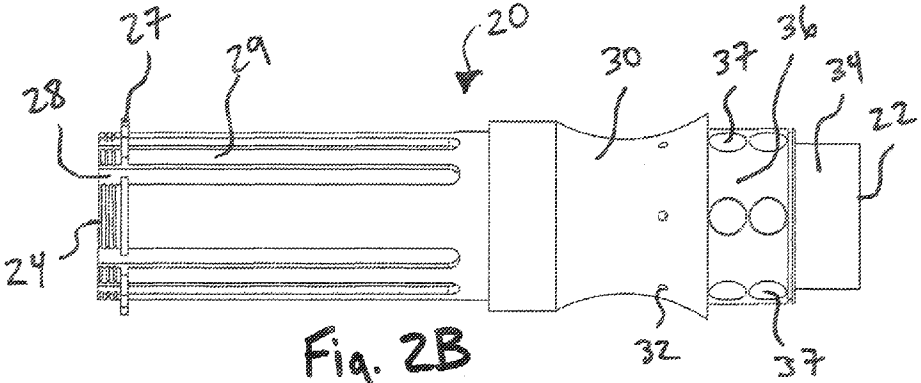
FIG. 2B is a side view of the component of an embodiment of a smoking device, depicted in FIG. 2A, in accordance with the present disclosure.
Figure 2C:
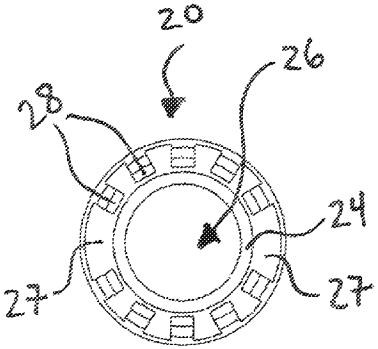
FIG. 2C is a rear view of a component of an embodiment of a smoking device, depicted in FIG. 2A, in accordance with the present disclosure.

With reference to FIGS. 2A-2C, embodiments of the smoking device 10 may comprise a body 20. The body 20 may be elongate in shape to mirror the elongate shape of the cigar. However, the shape of the body 20 may be cylindrical, rectangular, triangular, combinations of one or more of these shapes, or combinations of one or more other elongate shapes so long as the body 20 is configured to receive therein the cigar. The body 20 may be comprised of metals or other non-flammable materials. The body 20 may be comprised of aluminum to reduce the overall weight of the device 10 and to quickly disperse heat that emanates from the lit end of the cigar.

Embodiments of the smoking device 10 may comprise the body 20 further comprising a first end 22 and a second end 24, with a through bore 26 running through the axial length of the body 20 so that first end 22 and second end 24 are open. The first end 22 of the body 20 may further comprise a mouthpiece section 34. The body 20 may be structurally configured so that the cigar may be housed within the through bore 26. The cigar may be inserted into the device 10 and oriented within the through bore 26 such that the head of the cigar is proximate the mouthpiece section 34 and the foot of the cigar is proximate the second end 24 of the body 20. The configuration of the through bore 26 may provide that a gap 98 is present between the cigar and the interior surface 25 of the through bore 26. Embodiments of the smoking device 10 may comprise the mouthpiece 34 being configured to functionally engage the outer diameter of the cigar, as exemplarily depicted in FIG. 10, and thus releasably and repeatedly secure the cigar within the through bore 26, when inserted therein or removed therefrom by the user. The cigar may protrude from the mouthpiece by several inches or by several millimeters, depending on the preference of the user. As exemplarily depicted in FIG. 10, the cigar only slightly protrudes from the mouthpiece 34 at the first end 22 of the body 20. Embodiments of the smoking device 10 may comprise the interface between the mouthpiece 34 and the outer surface of the cigar being fluidicly sealed to prevent any cigar smoke from passing there between. The diameter of the bore in the mouthpiece 34 may be adjusted, or even adjustable, to accommodate for the girth or diameter of variously-sized products 6, including cigars of various sizes and diameters.

Embodiments of the smoking device 10 may comprise the body 20 further comprising one or more receptors 37 configured in the housing 36. The receptors 37 may be openings in the housing 36 that are configured to receive and contain a piston 60 therein. The receptors 37 may be cylindrical openings that run completely through the housing 36. The receptors 37 may be configured to have a first diameter and a second diameter, the first diameter being larger than the second diameter and the first diameter being positioned radially outward from the second diameter, such that the second diameter is positioned nearer to the through bore 26 than the first diameter. The receptors 37 may define an interior lip 31 where the first diameter meets the second diameter. The pistons 60 may be configured to be inserted within the receptor 37 and functionally engage the interior of the receptor 37, including the first diameter and/or the second diameter. The pistons 60 may have rotational movement within the receptors 37 but may also be configured to move radially within the receptors 37 in response to forces exerted on the pistons 60, which will be described herein. In other words, the pistons 60 may be configured to be move radially inward toward the through bore 26 of the body 20 and/or radially outward and away from the through bore 26 of the body 20, but yet all the while being retained within the receptors 37 such that the piston 60 does not fall out of the respective receptor 37.

Embodiments of the smoking device 10 may comprise the body 20 further comprising one or more grooves 28 configured in the exterior surface of the body 20. The grooves 28 may be configured to run along the length of the body 20 and may be spaced apart in equidistant measure about the outer surface of the body 20. The body 20 having grooves 28 therein spaced apart from one another creates corresponding ridges 29 in the exterior surface of the body 20. As a result, portions of the exterior surface of the body 20 may be configured to have alternating grooves 28 and ridges 29 therein.

Embodiments of the smoking device 10 may comprise the body 20 further comprising an exterior ring 27 configured about the exterior of the body 20 near the second end 24 of the body 20. The exterior ring 27 may have openings therein that correspond to the placement of the grooves 28. Further, the exterior end portions of the second end 24 may be configured with threads to receive thereon a collar 70, to be described herein. Moreover, the exterior ring 27 may be configured to abut a first end 72 of the collar 70, once coupled together.

Embodiments of the smoking device 10 may comprise the body 20 further comprising a saddle 30. The saddle 30 may be configured in the exterior of the body 20 and may have a generally concave shape to assist the user in gripping and handling the smoking device 10. The saddle 30 may be configured to have one or more ports 32 therein. The ports 32 may be configured to pass entirely through the body 20, such that the ports 32 may permit fluidic communication between the through bore 26 and the ambient air. The ports 32 may be configured to function as exhaust ports through which the cigar smoke may exhaust from the interior of the body 20 to the outside air under the condition the cigar is lit. The ports 32 may be configured on an end of the saddle 30 so as to be near or proximate the housing 36. In this way, the lit cigar may burn from the foot of the cigar all the way down the length of the cigar until the lit end of the cigar (i.e., the cherry) reaches the ports 32.

Figure 3:
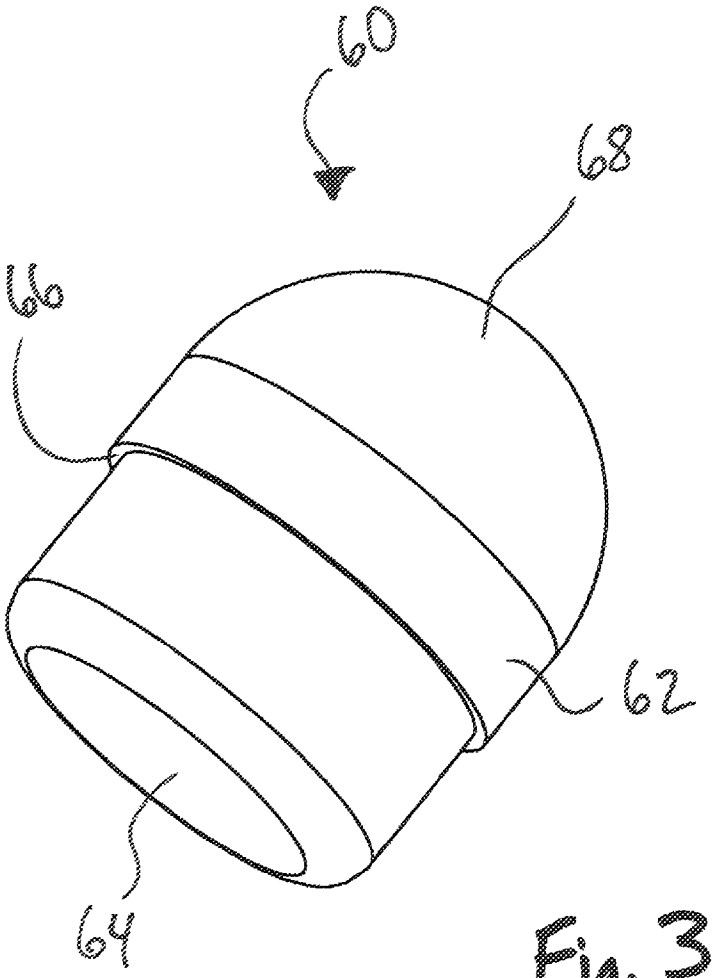
FIG. 3 is a perspective view of a component of an embodiment of a smoking device in accordance with the present disclosure.

With reference to FIG. 3, embodiments of the smoking device 10 may comprise the piston 60 comprising a first end 64 and a second end 68. The piston 60 may further comprise an exterior face 62 and an exterior ridge 66. The exterior face 62 may be configured to functionally engage (slidably engage) the first diameter of the receptor 37 and the exterior ridge 66 may be configured to functionally engage the interior lip 31 of the receptor 37, the interior lip 31 of the receptor 37 being configured to engage the exterior ridge 66 to prevent further advancement of the piston 60 within the receptor 37 when the piston 60 is pushed down into the receptor 37. The first end 64 of the piston 60 may be configured to contact and functionally engage the cigar placed within the through bore 26. The first end 64 may be a flat surface to engage the cigar by friction fit. Alternatively, the first end 64 may be a textured surface or other surface that is best configured to engage the delicate outer skin of the cigar and hold the cigar in place without damaging the cigar. The second end 68 may be configured in the size and shape to communicate with and/or functionally engage the inner hollow 48, to be described herein. The piston 60 may be comprised of metal or other magnetic material. Alternatively, portions of the piston 60 may be comprised of metal or other magnetic material.

Figure 4B:
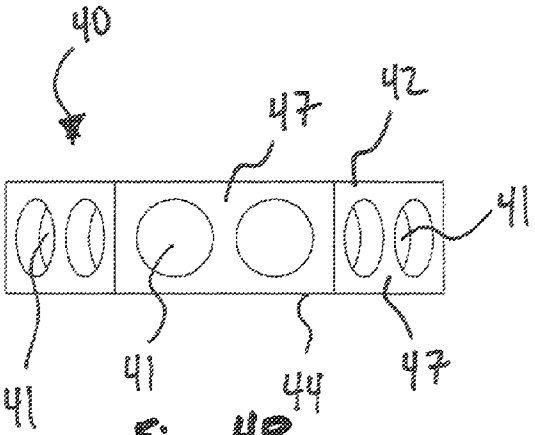
FIG. 4B is a side view of the component of an embodiment of a smoking device, depicted in FIG. 4A, in accordance with the present disclosure.
Figure 4C:
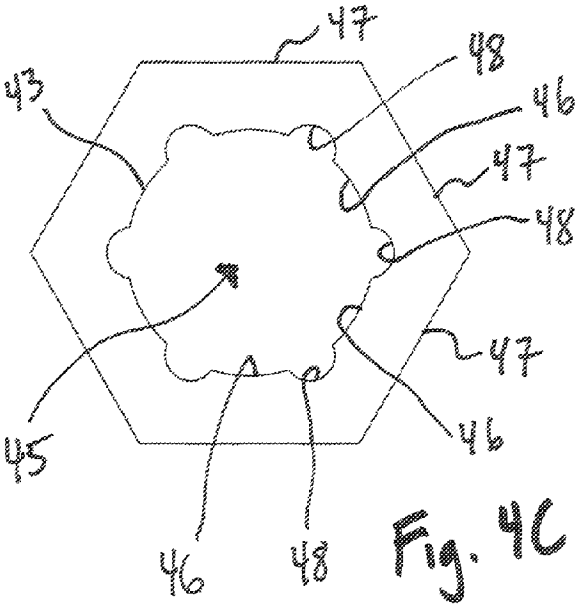
FIG. 4C is a front view of a component of an embodiment of a smoking device, depicted in FIG. 4A, in accordance with the present disclosure.
Figure 4A:
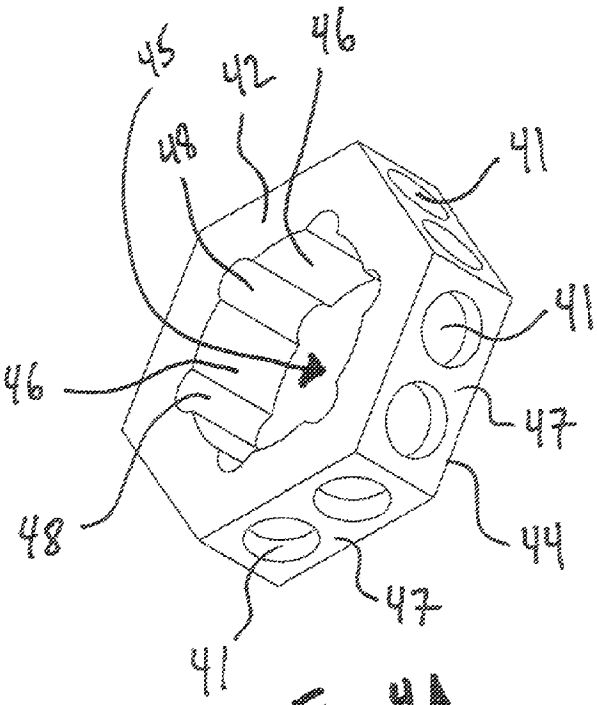
FIG. 4A is a perspective view of a component of an embodiment of a smoking device in accordance with the present disclosure.
Figure 5:
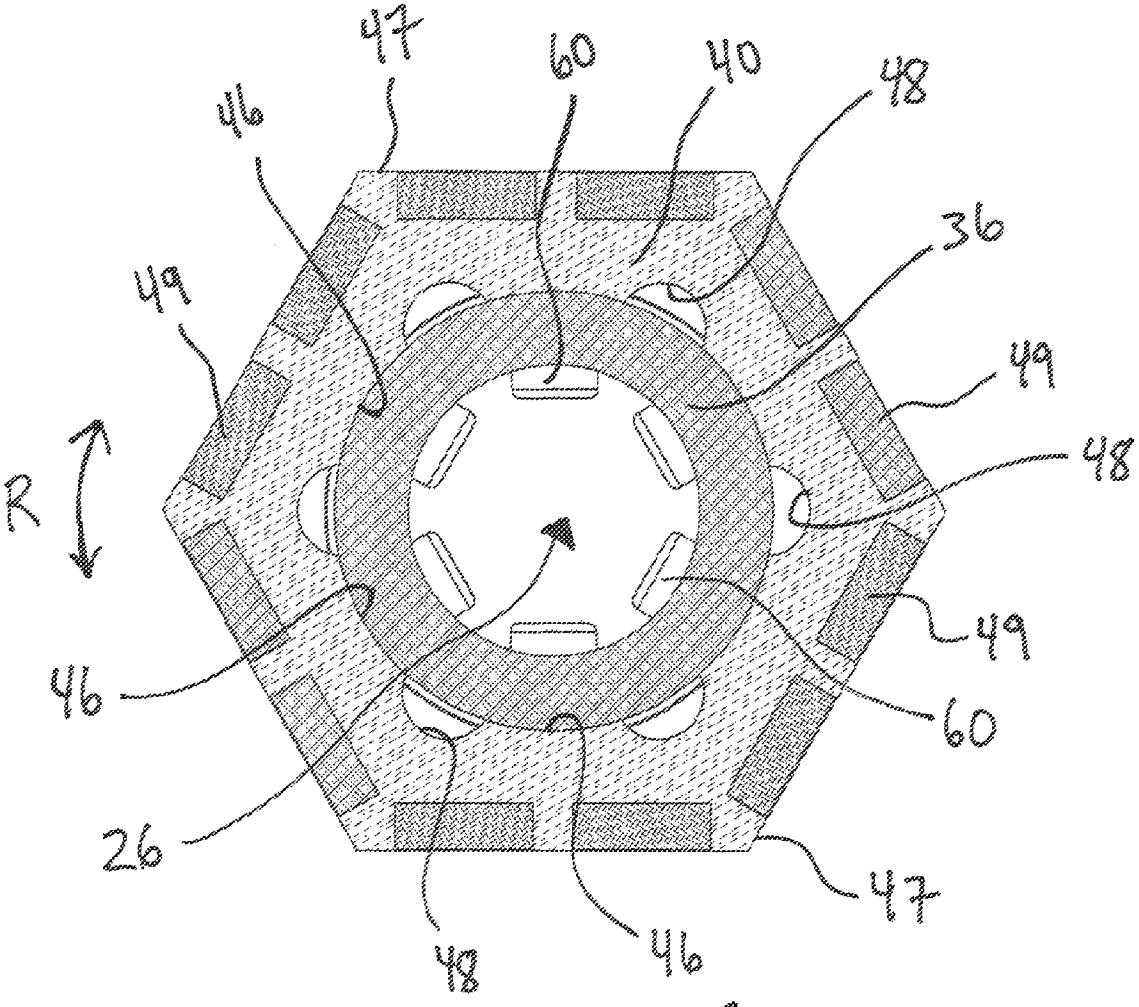
FIG. 5 is a side view of components of an embodiment of a smoking device coupled together, previously individually depicted in FIGS. 2A, 3, and 4A, in accordance with the present disclosure.

With reference to FIG. 4A-5, embodiments of the smoking device 10 may comprise a collet 40. The collet 40 may be configured to have a first end 42 and a second end 44, with a through bore 45 running through the axial length of the collet 40 so that first end 42 and second end 44 are open. The interior surface 43 of the through bore 45 may be configured to have a shape that corresponds to the shape of the housing 36, such that the through bore 45 may functionally communicate with the housing 36. The collet 40 may be further configured to have an outer surface 47 upon or in which one or more magnets 49 may be positioned. The outer surface 47 may further comprise one or more indentations 41 therein, the indentations 41 being configured to engage and/or retain therein the magnets 49. The collet 40 may be comprised of metals or other non-flammable materials. The collet 40 may be comprised of aluminum to reduce the overall weight of the device 10 and to easily and efficiently disperse the heat that may emanate from the lit end of the cigar. In alternative embodiments, magnets 49 may be sunk into the collet 40 to a depth such that the magnets 49 may function to magnetically adhere the collet 40 to the body 20 and prevent the collet 40 from disengaging from the body 20, except as desired by the user, but yet allowing the collet 40 to rotate with respect to the housing 36 as described herein. Also, other magnets may be positioned within the interior surfaces of the collet 40, so as to allow these interior magnets to magnetically adhere the collet 40 to the body 20 and prevent the collet 40 from disengaging from the body 20, except as desired by the user. A combination of these interior magnets and magnets 49 may also be utilized to achieve the desired purpose. In alternative embodiments, the collet 40 may be comprised of one or more flat surfaces on the exterior of the collet 40 to allow the smoking device 10 to interface with and rest securely on a surface, such as a motorcycle gas tank. In other words, by engaging the flat surface of the collet 40 against a relatively flat surface of the vehicle on which the user travels and on which the smoking device 10 is adhered, the smoking device 10 may not roll, twist, turn, rotate, or otherwise move with respect to the vehicle. Or at the very least, the flat surface on the collet 40 makes it more difficult for the smoking device 10 to roll, twist, turn, rotate, or otherwise move with respect to the vehicle. Further, the magnets 49 in the indentations 41 may serve to magnetically adhere the flat surfaces on the exterior of the collar to the metal surfaces on which the smoking device 10 may be placed. Embodiments of the smoking device 10 may further comprise some of the indentations containing the magnet 49 therein, while other of the indentations may not contain the magnet 49 therein.

Embodiments of the smoking device 10 may further comprise the through bore 45 of the collet 40 being further configured to have an inner diameter 46 and one or more inner hollows 48. The inner hollows 48 may be configured on the inner diameter 46 and may be positioned at predetermined intervals about the inner diameter 46. The inner diameter 46 and the inner hollows 48 may be configured to functionally engage the respective piston 60 positioned in the corresponding receptors 37 in the housing 36.

Specifically, as exemplarily depicted in FIG. 5, embodiments of the smoking device 10 may comprise the collet 40 being configured to functionally engage the housing 36, such that the collet 40 may be placed over the housing 36 so that the pistons 60 in the receptors 37 may thereby functionally engage the inner diameter 46 and the inner hollows 48. The collet 40 may be further configured to rotate about the housing 36 in the direction of arrow R. The pistons 60 in the receptors 37 may be positioned in the housing 36 such that the pistons 60 engage either the inner diameter 46 or the inner hollows 48, but not both at the same time. As a result, when the collet 40 is positioned on the collar 36 and the collet 40 is rotated with respect to the housing 36, the inner diameter 46 may engage the pistons 60, while the inner hollows 48 do not engage the pistons 60. Then, if the collet 40 is rotated circumferentially about the housing 36, the pistons 60 may disengage from the inner diameter 46 and may be engaged by the inner hollows 48. The collet 40 may continue to be rotated in a circumferential manner and the pistons 60 may alternately engage the inner diameter 46 and the inner hollows 48.

Under the condition the collet 40 has been rotated about the housing 36 such that the pistons 60 are engaged by the inner diameter 46, the inner diameter 46 may exert a radial force against the second end 68 of each of the pistons 60 and thereby radially press the pistons 60 down into the corresponding receptors 37 and thus down into the through bore 26 of the body 20 to place the first end 64 in functional contact and/or engagement with the cigar placed therein.

Yet, under the condition the collet 40 has been rotated about the housing 36 such that the inner hollows 48 are positioned over the second end 68 of the pistons 60, the magnets 49 may exert magnetic force on the pistons 60 to draw out the pistons 60 from the receptors 37 and into the inner hollows 48 to the point that the first end 64 of the pistons 60 is drawn out of the through bore 26 to release the cigar from functional engagement with the first end 64 of the respective pistons 60.

With this configuration, to position the cigar within the through bore 26, the collet 40 may be rotated about the housing 36 such that the inner hollow 48 is positioned over the second end 68 of the piston 60. In this manner, the magnetic force between the magnets 49 and the piston 60 can cause the piston 60 to retreat out of the through bore 26 and into the inner hollow 48 so that the cigar may be inserted within the device 10 in the through bore 26. Once properly inserted in the device 10, as determined by the user, the collet 40 may be rotated about the housing 36 such that the inner diameter 46 engages the pistons 60 to press the pistons 60 radially downward into the through bore 26 to cause the first end 64 of the respective pistons 60 to functionally engage the exterior surface of the cigar and thereby hold the cigar in place within the through bore 26. The collet 40 thus functions to hold the cigar in place within the device 10 until the user wishes to remove the cigar from the device 10, at which time the user may rotate the collet 40 with respect to the housing 36 to release the pistons 60 from functional engagement with the inner diameter 46 such that the pistons 60 may retreat into the inner hollow 48 and thereby retreat from the through bore 26, as described herein.

Figure 6:
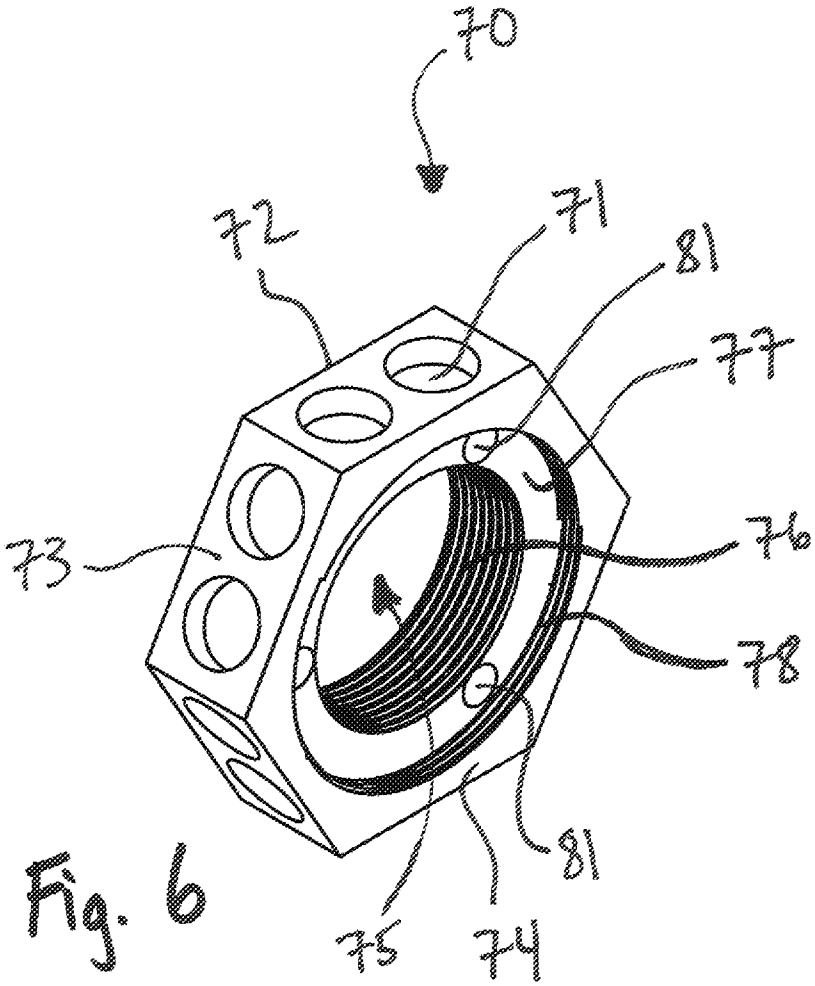
FIG. 6 is a perspective view of a component of an embodiment of a smoking device in accordance with the present disclosure.

With reference to FIG. 6, embodiments of the smoking device 10 may further comprise a collar 70. The collar 70 may comprise a first end 72 and a second end 74. The collar 70 may comprise a through bore 75 running between the first and second ends 72 and 74. The collar 70 may further comprise an outer surface 73 that may have indentations 71 therein. The indentations 71 may further be configured to receive therein and retain one or more magnets 79. The collar 70 may be comprised of metals or other non-flammable materials. The collar 70 may be comprised of aluminum to reduce the overall weight of the device 10 and to allow any heat that may emanate from the lit end of the cigar to dissipate easily and efficiently through the aluminum. The collar 70 may be comprised of one or more flat surfaces 73 on the exterior of the collar 70 to allow the smoking device 10 to interface with and rest securely on a surface, such as a motorcycle gas tank. In other words, by engaging the flat surface 73 of the collar 70 against a relatively flat surface of the vehicle on which the user travels and on which the smoking device 10 is adhered, the smoking device 10 may not roll, twist, turn, rotate, or otherwise move with respect to the vehicle. Or at the very least, the flat surface 73 on the collar 70 makes it more difficult for the smoking device 10 to roll, twist, turn, rotate, or otherwise move with respect to the vehicle. Further, the magnets 79 in the indentations 71 may function to adhere the collar 70 to the flat surface so that the smoking device does not move with respect to the flat surface, as described herein.

Embodiments of the smoking device 10 may further comprise the collar 70 having a first diameter 76 and a second diameter 78, the first diameter 76 being smaller than the second diameter 78, the first diameter 76 defining the size of the through bore 75. The first diameter 76 may be defined near the first end 72 of the collar and the second diameter 78 may be defined near the second end 74 of the collar 70. An interior rim 77 may be defined between the first diameter 76 and the second diameter 78. The interior rim 77 may define thereon depressions 81, to be described in greater detail herein.

Embodiments of the smoking device 10 may further comprise the first end 72 of the collar 70 being configured to functionally couple to the second end 24 of the body 20. The exterior threaded surface of the second end 24 of the body may be configured to functionally engage the first diameter 76 of the collar 70. As such, the first diameter 76 of the collar 70 may likewise be threaded. By threading the first diameter 76 over the exterior threaded surface of the second end 24, the first diameter 76 may functionally engage the ridges 29 in the body 20, but may not contact the grooves 28, given that the grooves 28 in the body 20 are configured to run under the first diameter 76 and not be impeded thereby. The first end 72 of the collar 70 may physically abut the exterior ring 27 of the body 20 to thereby prevent further axial advancement of the collar 70 onto the body 20. With the first end 72 of the collar 70 being oriented to face the body 20, the second end 74 of the collar 70 is oriented to face away from the body 20. In this manner, the second end 74 of the collar 70 is configured to receive the cap 50.

Figure 7A:
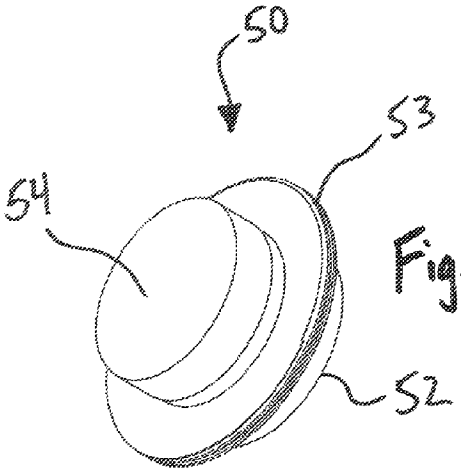
FIG. 7A is a perspective view of a component of an embodiment of a smoking device in accordance with the present disclosure.
Figure 7B:
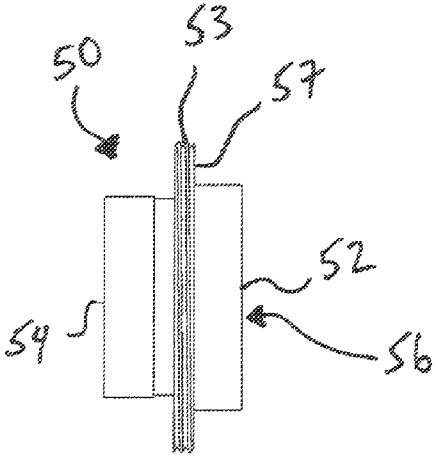
FIG. 7B is a side view of the component of an embodiment of a smoking device, depicted in FIG. 7A, in accordance with the present disclosure.
Figure 7C:
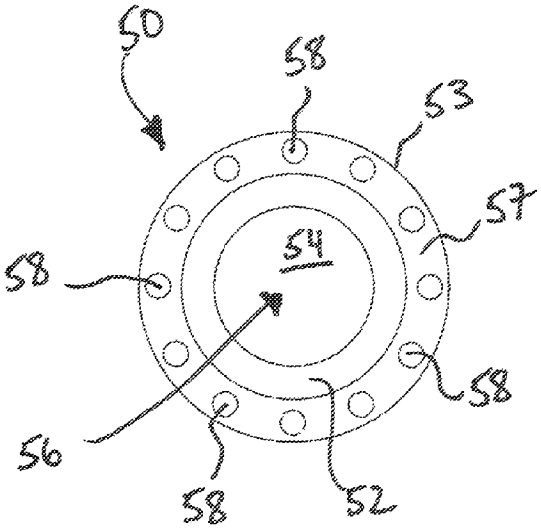
FIG. 7C is a front view of a component of an embodiment of a smoking device, depicted in FIG. 7A, in accordance with the present disclosure.

With reference to FIGS. 7A-7C, embodiments of the smoking device 10 may further comprise the cap 50. The cap 50 may further comprise a first end 52 and a second end 54. The first end 52 may be configured to be open, such that a cavity 56 is formed within the cap 50. The cap 50 may further comprise the second end 54 being closed. The cap 50 may further comprise an outer protrusion 53. The outer protrusion 53 may be circumferential and be threaded on the interior surfaces thereof. Embodiments of the smoking device 10 may further comprise the cap 50 being configured to be coupled to the second end 74 of the collar 70 via the outer protrusion 53. The first end 52 of the collar 50 may be inserted within the first diameter 76 of the collar 70, such that the outer protrusion 53 may functionally engage the second diameter 78 of the collar 70 and the first end 52 of the collar 50 may reside in proximity to the second end 24 of the body 20. In this way, the cavity 56 of the cap 50 may functionally communicate with the through bore 26 of the body 20. The cap 50 may be configured to be releasably and repeatedly inserted onto and removed from the collar 70, as desired by the user.

Figure 8:
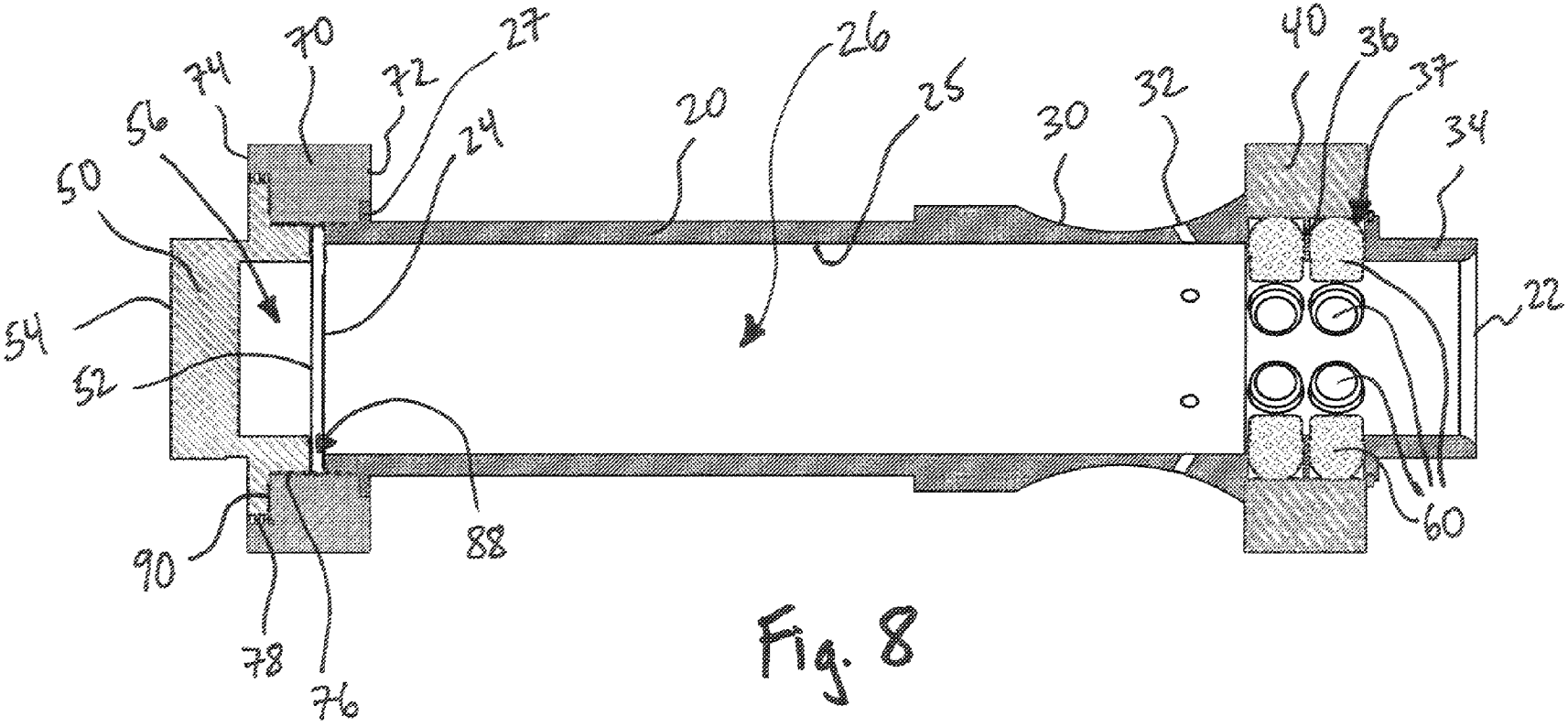
FIG. 8 is a cross section view of an embodiment of a smoking device in accordance with the present disclosure.

With reference to FIG. 8, embodiments of the smoking device 10 may further comprise the cap 50 being adjustable with respect to the collar 70 and the body 20. The cap 50 may be adjustable by threading the cap 50 in or out with respect to the collar 70. By so doing, a space 88 between the second end 24 of the body 20 and the first end 52 of the cap 50 may be adjusted to permit air flow into not only the cavity 56 but also into the through bore 26. In this way, the second end 24 of the body 20 is not fluidicly sealed by the cap 50, but instead a flow of air is permitted into the through bore 26 by way of the grooves 28 under the collar 70 and the space 88 between the body 20 and the cap 50. In other words, ambient air may flow into and down through the grooves 28, under the collar 70, down into the cavity 56 within the cap 50, and down into the through bore 26 to reach the lit end of the cigar to allow the lit end of the cigar to burn under the conditions described herein.

With reference to FIGS. 7A-7C, embodiments of the smoking device 10 may further comprise the cap 50 defining a surface 57 having one or more dimples 58 thereon. The surface 57 may be configured to face the first end 52 of the cap 50. As such, the surface 57 may be configured to face the second end 74 of the collar and thus the interior rim 77 having the depressions 81 thereon. The dimples 58 and the depressions 81 may be configured to functionally communicate with one another via a pin 90.

Figure 9:
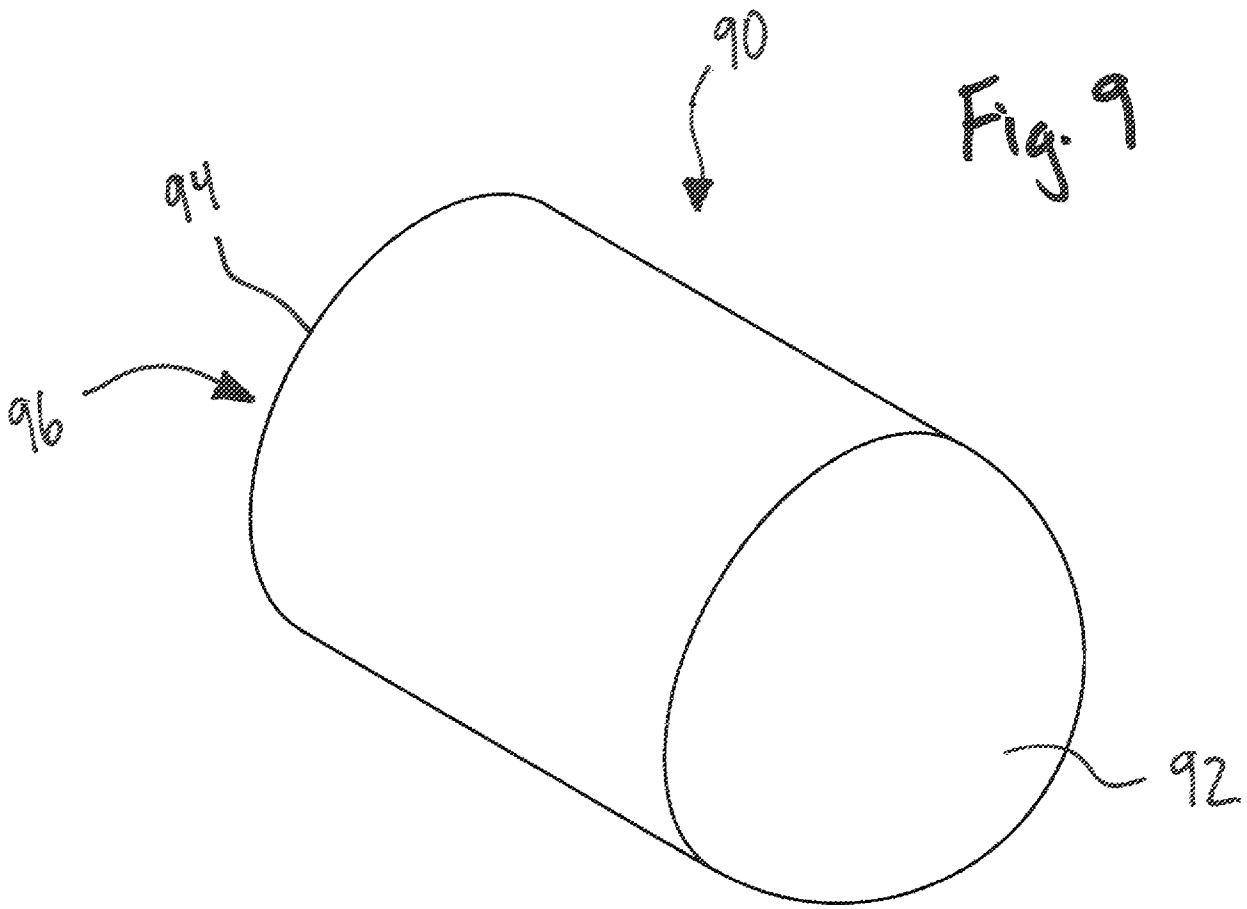
FIG. 9 is a perspective view of a component of an embodiment of a smoking device in accordance with the present disclosure.

With reference to FIG. 9, embodiments of the smoking device 10 may comprise the pin 90 having a first end 92 and a second end 94. The first end 92 may define a rounded surface. The second end 94 may define a hollow 96 therein. The hollow 96 may be configured to receive and retain a biasing member 98 (not depicted). The pin 90 may be inserted between the collar 70 and the cap 50. In particular, the biasing member 98 may be inserted within the hollow 96 and the second end 94 of the pin 90 may be inserted within a corresponding depression 81. As such, the biasing member 98 may exert force against the depression 81 and thus the interior rim 77 and thus the collar 70. The cap 50 may be inserted onto the collar 70, as described herein, and the first end 92 of the pin 90 may make physical contact and engage the dimples 58 in the surface 57. As the cap 50 is rotated with respect to the collar 70 to threadably engage the cap 50 with the collar 70, the first end 92 of the pin 90 will temporarily engage one of the corresponding dimples 58 to create a clicking sound or a clicking engagement, as the first end 92 of the pin 90 moves in and out of respective dimples 58. By having the biasing member 98 within the pin 90, and the pin 90 contacting both the collar 70 and the cap 50, the biasing member 98 is configured to provide audible and tactile feedback to the operator regarding the positioning between the cap 50, the collar 70, and the body 20. In other words, the configuration of the pin 90 may be designed to provide a means for the user to properly position the cap 50 with respect to the second end 24 of the body 20 to provide for the desired amount of air flow through the space 88, and to do so by means of audible sound and tactile feedback.

For example, each click of the pin 90 from one dimple 58 to a neighboring, or successive, dimple 28 may result in the cap 50 moving toward or away from the second end 24 of the body 20, as the case may be, by about 0.025 inches. In other words, by rotating the cap 50 such that the pin 90 engages successive dimples 58, each time the pin 90 engages the next dimple 58, the cap 50 may move toward the second end 24 of the body 20 or away from the second end 24 of the body 20 by about 0.025 inches depending on the rotational direction of the cap 50, being that the cap 50 is threadably engaged with the collar 70 and the collar is threadably engaged by the body 20. Applicant has conducted testing on the flow of air through the gaps 28, the space 88, the cavity 56, and into the through bore 26. Applicant has found that threading the cap 50 completely against the second end 24 of the body 20 restricts the amount of air that can flow through the throughbore, if any at all flows through the through bore 26 under these conditions. However, by clicking the cap 50 one click (i.e., moving the pin 90 from one dimple 58 to the next neighboring dimple 58), the user may allow a restricted air flow through the through bore 26. Likewise, by clicking the cap 50 a second click in addition to the one click, the user may allow a greater restricted air flow through the through bore 26. Likewise, by clicking the cap 50 a third click in addition to the two previous clicks, the user may allow an even greater restricted air flow through the through bore 26. This pattern may continue for several clicks until the space 88 between the cap 50 and the second end 24 of the body 20 is large enough that the air flow into the cavity 56 and through bore 26 is no longer restricted, but flows freely. In other words, by use of the pin 90 as described herein, the user can use the "clicks" to alter, change, restrict, limit, modify, vary, regulate, adjust, or otherwise affect the flow of air into the through bore 26.

A user may therefore use the number of audible and tactile clicks to determine the position of the cap 50 from the second end 24 of the body 20, or in other words the size of the space 88, to account for the desired amount of airflow into and through the through bore 26.

The pin 90 may be further configured to retain the configuration of the cap 50, the collar 70, and the body 20 with respect to one another due to the engagement of the first end 92 of the pin 90 with one of the corresponding dimples 58. In other words, without the application of additional force provided by the user, once the cap 50 has been threadably set with respect to the collar 70 and the body 20, the cap 50 will not accidentally retreat from off the collar 70 due to the engagement of the pin 90 within a corresponding dimple 58.

Figure 10:
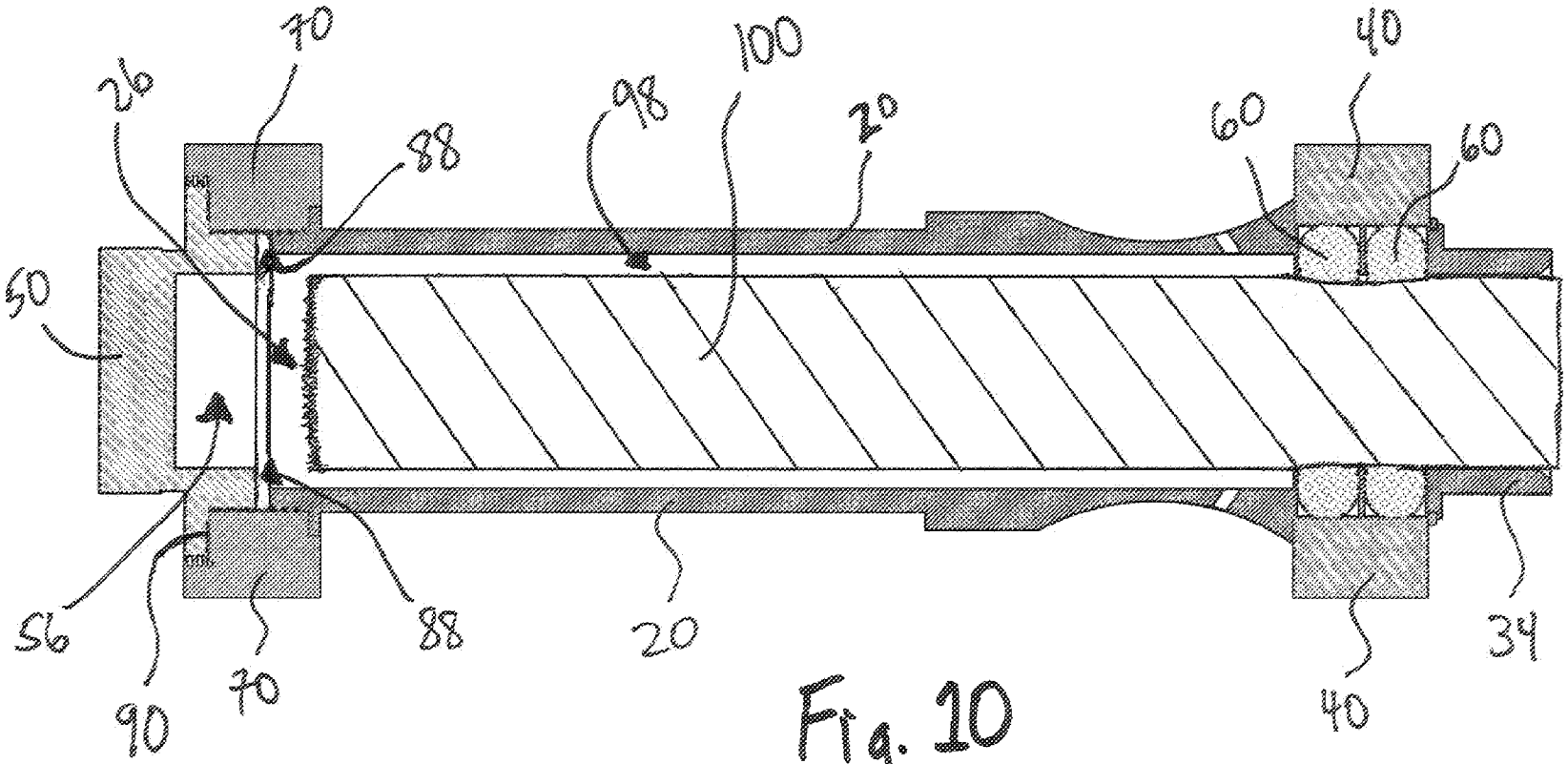
FIG. 10 is a cross section view of an embodiment of a smoking device having a smoking product therein in accordance with the present disclosure.

With reference to FIG. 10, embodiments of the smoking device 10 may further comprise a cigar 100 being placed within the through bore 26 of the body 20, such that the head of the cigar 100, or a portion of the cigar 100 near the head, functionally engages the mouthpiece 34 and the foot of the cigar 100 resides proximate to the second end 24 of the body 20. The collet 40 may be placed on the housing 36, such that the pistons 60 functionally engage the cigar 100 within the through bore 26 to hold the cigar 100 in place, as described herein. The cigar 100 may be lit and the cap 50 may be placed onto the second end 74 of the collar 70. Once the cigar 100 is lit and properly secured within the smoking device 10, the user may puff on the cigar 100 near the mouthpiece 34 and enjoy the flavors of the cigar 100. The positioning of the cigar 100 within the body 20 allows the cigar 100 to not contact the interior of the through bore 26. Instead, the configuration of the body 20 and the through bore 26, with respect to the cigar 100, provides an air gap 98 around the exterior of the cigar 100 between the cigar 100 and the interior surface 25 of the through bore 26. This air gap 98 facilitates air movement around the cigar 100 and provides that the cigar 100 may burn evenly within the body 20. As the user puffs on the cigar 100 within the body 20, ambient air may be drawn onto the lit end of the cigar 100 to cause the cigar 100 to burn. This ambient air is drawn onto the cigar 100 by way of the space 88 between the second end 24 of the body 20 and the first end 52 of the cap 50, the space 88 being defined by a combination of the grooves 28, the collar 70, the cap 50, the cavity 56, and the air gap 98 in the through bore 26 around the cigar 100. When the user is not actively puffing on the cigar 100, the smoke from the lit end of the cigar 100 may exhaust out of the body 20 by way of the exhaust ports 32. Thus, even without windy conditions, the user may enjoy smoking the cigar 100 that is positioned in the smoking device 10.

Yet, it is under windy conditions that the smoking device 10 excels in its purpose. The structural configuration of the smoking device 10 protects the cigar 100 within the body 20 from the dangers of swirling currents and the velocity of direct wind. The structural configuration of the body 20 controls the influx of ambient air that reaches the lit end of the cigar 100, in accordance with the configuration described above, thus allowing the cigar 100 to burn at a controlled and even rate. Indeed, the orientation of the smoking device 10 in the direction of the ambient wind flow functions to control the flow of air that reaches the cigar 100.

For example, under the condition the smoking device 10 is oriented length-wise in the direction of wind flow with the first end 22 of the body 20 in front and the second end 24 of the body 20 in back, such that the wind flow contacts the first end 22 first, the grooves 28 in the body 20 function to receive the flowing wind therein and direct and channel the flowing wind into the cavity 56 by way of the space 88 between the grooves 28, the collar 70, and the cap 50. The pressure and current of the flowing ambient air in the grooves 28 causes the ambient air to enter the space 88 and thus enter the cavity 56, similar in ways to a "ram air" effect. The flowing air entering the cavity 56 is then diffused and directed by the interior of the cap 50 into the through bore 26, such that the flowing air flows through the through bore 26 and evenly over the lit end of the cigar 100. The flowing air continues to flow over the cigar 100 within the through bore 26 until it reaches the exhaust ports 32, which act like a flue in a chimney to direct the flow of air out of the body 20. Indeed, once the air within the through bore 26 reaches the exhaust ports 32, the air exits the body 20. Thus, with the smoking device 10 oriented lengthwise in the direction of the flow of wind with the first end 22 being the leading end, the structural configuration of the smoking device 10 causes a circulation of controlled air flow through the body 20 to cause the cigar 100 to burn at a controlled and even rate, notwithstanding the variable wind conditions that may be occurring outside the body 20. In addition, by having the cigar 100 encased within the body 20, there is little or no danger of having ash blow back into the user's face.

Further in example, under the condition the smoking device 10 is oriented length-wise in the direction of wind flow with the second end 24 of the body 20 in front and the first end 22 of the body 20 in back, such that the wind flow contacts the second end 24 first, the cap 50 on the second end 24 functions to cause the ambient air flow to flow over the top of the cap 50 and over the top of the space 88, such that little, if any, air flow enters the cavity 56 through the space 88. Being oriented in this way, the grooves 28 do not serve the purpose of directing and channeling ambient air flow into the space 88. Instead, the air flow over the cap 50 and over the space 88 causes a vacuum-like effect on the space 88 that restricts, or even prevents, the ambient air flow from entering the space 88 and thus from entering the cavity 56 and thus from entering the through bore 26 to reach the cigar 100. As a result of an absence of air flow within the through bore 26, the lit end of the cigar 100 may not receive the necessary oxygen to continue to burn and may self-extinguish.

Embodiments of the smoking device 10 may comprise magnets 49 and 79 described herein. The magnets 49 and 79 may allow a user to magnetically adhere the smoking device 10 to a recreational vehicle, such as a boat or a motorcycle, while in operation of the vehicle. Thus, when a user of the device 10 wishes to safely smoke a cigar 100 while operating the vehicle, the user may magnetically adhere the device 10 to the vehicle during intervals when the user is not puffing on the cigar 100 or device 10. Moreover, the operator may orient the device 10 in the direction of travel according to the desired use of the cigar 100. When the operator desires to smoke while operating the vehicle, the operator may orient the device 10 lengthwise in parallel with the direction of wind flow, with the first end 22 being the leading end, such that the flow of air resulting from movement of the vehicle enters the grooves 28, the space 88, the cavity 56, and the through bore 26 to evenly burn the cigar 100, as described herein. Then, when the user wishes to puff on the cigar 100, the user may simply remove the device 10 from the vehicle by disengaging the magnets 49 and 79, puff on the mouthpiece 34 as desired, and then replace the device 10 in the proper orientation on the vehicle to maintain the burn on the cigar 100, as herein described. On the other hand, when the operator is finished smoking while operating the vehicle, the user may simply orient the device 10 lengthwise in parallel with the direction of wind flow, with the second end 24 being the leading end, such that the flow of air resulting from movement of the vehicle flows over the cap 50 and thus over the space 88, such that air does not flow into the space 88, the cavity 56, or the through bore 26, which extinguishes the cigar 100, as described herein.

In other words, by switching the orientation of the device 10 in the flow of ambient air can cause the cigar 100 therein to continue to evenly burn or self-extinguish, as described herein and as desired by the user.

Embodiments of the smoking device 10 may comprise the device 10 being configured to function as a receptacle for consumed cigars 100. Under the condition the user has finished smoking any particular cigar 100, the user may push the head of the cigar 100 through the mouthpiece 34 to disengage the cigar 100 from the mouthpiece 34. In this way, the cigar 100 is pushed further into the through bore 26 of the body 20 and is contained therein until the user removes the cap 50 and empties the cigar 100 from the body 20.

In addition to the methods of using the smoking device 10 described above, a method of smoking a cigar 100 will herein be described in greater detail. The method may comprise providing a smoking device 10, inserting a cigar 100 into the smoking device 10, placing a collet 40 on the smoking device to secure the cigar 100 within the smoking device 10, lighting the cigar 100 at the foot, placing a cap 50 on the smoking device 10 over the lit end of the cigar 100, puffing on the mouthpiece 34 of the smoking device 10 to draw air down the grooves 28 in the exterior of the device 10 such that air passes through the space 88 into the cavity 56 of the cap 50 and into the through bore 26 in the body 20 to reach the lit end of the cigar 100.

The method may further comprise orienting the smoking device 10 in the direction of travel while operating a motorized vehicle. The method may further comprise orienting the first end 22 in the direction of travel. The method may further comprise orienting the second end 24 in the direction of travel. The method may further comprise pushing the cigar 100 through the mouthpiece 34 to move the cigar 100 completely within the through bore 26.

The components defining the above-described smoking device 10 may be formed of any of many different types of materials or combinations thereof that can readily be formed into shaped objects provided that the components selected are consistent with the intended operation of a smoking device of the type and function disclosed herein. For example, and not limited thereto, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining the above-described smoking device 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A smoking device comprising:

a body having a first end, a second end, and a through bore running from the first end to the second end, the body being configured to house a product in the through bore;

a cap configured to be adjustable with respect to the body to define a space between the cap and the body, the space being in fluidic communication with the through bore; and grooves in an exterior surface of the body, wherein the grooves are in fluidic communication with the space; and a collar configured to operatively engage the second end of the body, the cap being configured to operatively engage the collar and be adjustable with respect to the collar to define the space between the cap and the second end.

2. The smoking device of claim 1, further comprising a collet configured to operatively engage the body proximate the first end of the body, wherein the collet is configured to rotate with respect to the body to transition the smoking device between an engaged state and disengaged state.

3. The smoking device of claim 1, wherein the grooves are configured to run underneath the collar to establish the fluidic communication with the space.

4. The smoking device of claim 2, further comprising a receptacle in the body, the receptacle being configured to house a piston, wherein the collet is configured to operatively engage the piston such that rotation of the collet to the engaged position moves the piston radially inward and wherein rotation of the collet to the disengaged position permits the piston to move radially outward.

5. The smoking device of claim 4, wherein in the engaged position the piston contacts the product to retain the product within the through bore and wherein in the disengaged position the piston releases contact with the product.

6. The smoking device of claim 4, wherein in the engaged position contact force moves the piston radially inward and wherein in the disengaged position magnetic force moves the piston radially outward.

7. The smoking device of claim 1, further comprising magnets on an exterior surface of the smoking device.

8. The smoking device of claim 1, further comprising a port in the body, the port being configured to establish fluidic communication between the through bore and ambient air.

9. The smoking device of claim 1, wherein the body is configured to house the product within the through bore with a gap between the product and the interior surface of the through bore.

10. The smoking device of claim 1, further comprising a biasing member configured between the collar and the cap to bias the cap away from the body.

11. The smoking device of claim 1, further comprising a mouthpiece proximate the first end of the body, the mouthpiece being configured to operatively engage the product.

12. A smoking device comprising:

a body having a first end, a second end, and a through bore running from the first end to the second end, the body being configured to house a cigar in the through bore;

a collar configured to operatively engage the second end of the body;

a cap configured to operatively engage the collar and to be adjustable with respect to the second end of the body, the cap and the second end defining there between a space, the space being in fluidic communication with the through bore;

grooves in an exterior surface of the body, wherein the grooves are configured to run underneath the collar to establish the fluidic communication with the space;

a mouthpiece configured to operatively engage the cigar; and a collet configured to operatively engage the body proximate the first end of the body, the collet being configured to rotate about the body to transition the smoking device between an engaged state and disengaged state, wherein in the engaged state the cigar is secured within the through bore and wherein in the disengaged state the cigar is removable from the through bore.

13. The smoking device of claim 12, further comprising a receptacle in the body, the receptacle being configured to house a piston, wherein the collet is configured to operatively engage the piston such that rotation of the collet to the engaged position moves the piston radially inward and wherein rotation of the collet to the disengaged position permits the piston to move radially outward.

14. The smoking device of claim 13, wherein in the engaged position the piston contacts the product to retain the product within the through bore and wherein in the disengaged position the piston releases contact with the product.

15. The smoking device of claim 13, wherein in the engaged position contact force moves the piston radially inward and wherein in the disengaged position magnetic force moves the piston radially outward.

* * * * *